United States Patent [19]

Mukenschnabl

[11] 4,448,363

[45] May 15, 1984

[54] REWINDER APPARATUS

[76] Inventor: Donald F. Mukenschnabl, 4026 Elm, Downers Grove, Ill. 60515

[21] Appl. No.: 238,486

[22] Filed: Feb. 26, 1981

[51] Int. Cl.[3] ..... B65H 23/08

[52] U.S. Cl. ..... 242/67.3 R; 242/68.7; 242/75.41

[58] Field of Search ..... 242/67.1, 67.3 R, 66, 242/75.41, 75.42, 75.2, 55, 68.7, 78.7

[56] References Cited

U.S. PATENT DOCUMENTS

| | | | |
|---|---|---|---|
| 1,713,382 | 5/1929 | Hammel | 242/66 |
| 1,853,292 | 4/1932 | Wood | 242/75.41 |
| 1,937,412 | 11/1933 | Roesen | 242/75 |
| 2,040,775 | 5/1936 | Lorig | 242/78 |
| 2,387,644 | 10/1945 | Coffey | 242/66 |
| 3,006,569 | 10/1961 | Hasselquist | 242/67.3 R |
| 3,140,839 | 7/1964 | Whitecar | 242/68.1 |
| 3,299,484 | 1/1967 | Pernick | 26/70 |
| 3,695,533 | 10/1972 | Shedyak | 242/68.7 X |
| 3,900,063 | 8/1975 | Roller | 242/68.7 X |
| 3,921,928 | 11/1975 | Henry | 242/75.43 |

*Primary Examiner*—Stuart S. Levy
*Assistant Examiner*—David J. Werner
*Attorney, Agent, or Firm*—Welsh & Katz

[57] ABSTRACT

A rewinder method and apparatus. A roll end having newsprint thereon is supported on a pair of free-wheeling pocket rollers, positioned on the pocket rollers by slideable end plates. Leather straps are resiliently urged against the roll end to act as a payout brake as the newsprint from the roll end is wound onto a collector roll for salvaging. In its operational form, the apparatus is further comprised of means for rotating the collector roll so as to wind the material from the roll end thereupon. The invention also comprises the method of rewinding newsprint from a partially full non-axially driven roll onto a collector roll, comprising the steps of positioning and securing the roll end on a free wheeling surface, positioning and securing the collector roll in a rotatable manner on a surface, securing the newsprint from the roll end to the newsprint on the collector roll, and rotating the collector roll so as to wind the newsprint from the roll end onto the collector roll.

35 Claims, 3 Drawing Figures

REWINDER APPARATUS

BACKGROUND OF THE INVENTION

1. Field of the Invention

This invention relates to the rewinding of newsprint salvage on the ends of rolls, and more specifically to an apparatus and the method for rewinding newsprint salvage from the ends of rolls.

2. Description of the Prior Art

Heretofore, the principal way utilized to salvage the newsprint from roll ends was to successively thread each end of roll (roll ends) onto a spindle and rewind the remaining newsprint on a new roll thereby accumulating the newsprint from many ends of rolls on a single roll. This was laborious and time consuming, and it was generally found to be more economical to discard the small ends of the rolls rather than to salvage the newsprint. Alternatively, salvage equipment was available which employed some sort of chuck mechanism for handling the roll ends, but had the disadvantage of being expensive, and often not economically feasible.

SUMMARY OF THE INVENTION

According to the present embodiment of the invention, the roll ends are not threaded onto a spindle, but are, instead, supported on a pair of pocket rollers which are free wheeling and non-driven. Slideable end plates provide means for positioning the roll ends on the pocket rollers, and leather straps provide means which are resiliently urged against the roll ends to act as a payout brake. Newsprint from the roll ends is coupled to a collector roll which is rotatably driven, thereby winding the newsprint from the roll end onto the collector roll so as to salvage the newsprint. This arrangement provides considerable savings in the amount of labor and time required to handle the roll ends, and makes salvage of the newsprint from the roll ends economical and speedy.

In accordance with the above, the present embodiment of the invention broadly includes a rewinder apparatus for receiving a roll end comprising a free wheeling means, such as pocket rollers, for supporting the roll end, and end means, such as end plates, for positioning the roll end on said free wheeling means for supporting the roll ends, and means, such as pneumatically driven leather straps, for resiliently urging against the roll end responsive to a control stimulus. The control stimulus may be a user provided signal, such as an electrical signal provided by an on/off switch, or may be a signal provided responsive to rotation of a collector roll. In its operational form, the apparatus is further characterized in that the roll end has material thereon, such as newsprint, and said apparatus is further comprised of a collector means, such as a collector roll, for receiving and accumulating the material thereupon. The apparatus is further comprised of means for rotating the collector means so as to wind said material thereupon. The means for rotating is, in the illustrated embodiment, comprised of a motor driven axle abutting the collector means. Alternatively, the means for rotating may be, for example, a manually driven shaft, said shaft having a rod abutting said collector means for rotating the collector means with rotation of the rod, or rollers which are driven so as to cause rotation of the collector roll.

In the illustrated embodiment, rotation of the collector roll is in a second direction, thereby forcing rotation of said roll end in a first direction. In the illustrated embodiment, the first direction is opposite to the second direction. Thus, for example, the collector roll is driven to rotate in a counterclockwise direction, winding the material upon the collector roll in the counterclockwise direction, while rotation of the roll end is in a clockwise direction, the material, such as newsprint, unwinding from the roll end in a clockwise direction feeding to and winding upon the collector roll.

In the illustrated embodiment, the free wheeling means for supporting is comprised of a first and a second pocket roller in spaced parallel relation to one another. The roll end is positioned upon said first and second pocket rollers, with said material (such as newsprint) fed down between said first and second pocket rollers, and coupled to the collector roll. Thus, rotation of said collector roll exerts a force upon the material on the roll end, thereby rotating the roll end upon said free wheeling pocket rollers.

The means for positioning is, in the preferred embodiment, comprised of slideable end plates lying partially within the space between said first and second pocket rollers, the end plates being movable along an axis parallel to the rollers for contacting the roll end. The end plates secure the roll ends upon the first and second pocket rollers, allowing only rotational movement of the roll end.

The apparatus is further comprised of means for selectively braking the roll ends, said means comprised of said means for selectively resiliently urging against the roll ends. The resilient urging against the roll end acts as a payout brake so as to maintain a uniform range of tension on the roll end and the material thereon such that rotation of the collector roll in conjunction with the means for selectively braking maintains a uniform range of tension upon the material propagating from the roll end to the collector roll.

In the illustrated embodiment, the means for selectively resiliently urging against the rail ends comprised of tension arms having pneumatically positioned leather straps thereupon. The leather straps are pneumatically positioned so as to abut or press or push against the roll end. Alternatively, such straps may be comprised of a vinyl, or other flexible material mounted upon the tension arms. The tension arms are, for example, comprised of a solid material, such as metal, wood, plastic, or other suitable substance having the necessary structural strength.

In the illustrated embodiment, the apparatus is further comprised of a side frame, and a rod mounted to said side frame, wherein the slideable end plates are mounted for movement along said rod, said rod and said pocket rollers are mounted to said side frame in parallel spaced relation to one another, said rod being positioned in between said pocket rollers, and said collector means is mounted to said side frame in spaced parallel relation to said pocket roller. Thus, the apparatus forms a complete pocket web rewinder comprising a single interrelated structure, with the interrelated subparts being aligned in parallel relation to one another.

The apparatus is further comprised of a means for selectively positioning the slideable end plates responsive to a user stimulus. For example, a manual sidelay adjustment is, in one embodiment, provided wherein a user generated movement of said sidelay adjustment causes lateral movement of the end plates towards one another, or away from one another, so as to be selectively positionable to secure the roll ends. Alternatively, other mechanical, electromechanical, pneumatic, or other means may be provided for selectively positioning the slideable end plates to secure the roll end.

In an alternate embodiment, a rewinding apparatus is comprised of a frame having a mounting surface atop one end. The mounting surface is positioned and engineered for receipt of a wound roll (or collector roll). The apparatus is further comprised of spaced pocket rollers rotatably mounted in a free wheeling manner to the frame, parallel to the mounting surface. The pocket rollers are free wheeling, that is, mounted for low friction rotation, and are nondriven. The parallel relationship of the pocket rollers mounting to the mounting surface provides a parallel plane through which a material (newsprint in a preferred embodiment) may propagate from between the pocket rollers to a collector roll mounted atop the mounting surface. The apparatus is further comprised of end plates positioned adjacent said rollers and lying in a plane transverse to the axis of the rollers, said plates mounted for movement along a path parallel to said rollers axis. The end plates provide a means for positioning and securing a roll end having material thereupon on top of and abutting the pocket rollers, without restricting rotational movement of the roll end. The end plates are of a suitable material for providing structurally sound securement and positioning of the roll ends atop the pocket rollers, such as metal end plates, wood, hardened plastic, or other suitable material. The apparatus is further comprised of straps mounted to the frame in spaced parallel relation to said rollers, said straps ascending towards and above said rollers. The straps, or tension arms, provide a means for selectively resiliently urging against the roll end when mounted atop the pocket rollers.

The apparatus is further characterized, in the alternate embodiment, in that said straps and said frame form an acute angle in the direction of said rollers. The straps may thus be positioned atop the pocket rollers, providing additional securement of said roll end and providing a greater surface area of interaction between said straps and said roll end so as to act as a payout brake.

In the alternate embodiment, the apparatus is further comprised of a roll end having material (such as newsprint) thereon, said roll end mounted atop said rollers and between and abutting said rollers. The newsprint from the roll end is fed between the rollers, such that applying a downwardly directed force to said material causes the roll end to rotate upon the pocket rollers and feed the material between said pocket rollers.

The apparatus is further characterized in that said straps are pivotably mounted to the frame and are selectively resiliently urgable against the roll end responsive to a control stimulus. Thus, for example, upon activation of the apparatus as a system, a control stimulus is provided which causes the straps to pivot and resiliently urge against the roll end, thereby acting as a payout brake to maintain a uniform tension upon the material, and acting so as to limit the rotational speed of the roll end upon the pocket rollers.

The apparatus is further characterized in that said straps act so as to brake the motion of the roll end when they are resiliently urged against the roll end. This provides limiting of the rotational speed of the roll end, and maintains a uniform tension on the material being unwound from the roll end.

The apparatus is further characterized in that said straps are selectively resiliently urged by a pneumatic movement means. For example, tension is applied with air actuated leather belts attached to tension arms in the preferred alternate embodiment.

The apparatus is further comprised of a collector roll having other of said material wound thereupon, said roll being mounted atop said mounting surface. The collector roll is, for example, a roll of newsprint material, with the collector roll being an accumulator for collecting and salvaging newsprint material from a plurality of roll ends.

In the preferred alternate embodiment, the apparatus is further characterized in that the mounting surface is comprised of bushings recessed atop said frame. The bushings provide a receptacle for a support member upon which the collector roll is mounted so as to allow for low friction rotation of the collector roll.

The apparatus is further comprised of a means for rotating the roll end and the collector roll so as to wind the material from the roll end onto the collector roll. Thus, the material from the roll end, upon being coupled to the material on the collector roll, winds onto the collector roll from the roll end responsive to rotation of the collector roll and roll end.

In the preferred alternate embodiment, the apparatus is further characterized in that the means for rotating is comprised of a motor driven rod abutting and driving the collector roll, said rod being coupled to said mounting surface. Thus, rotation of the collector roll exerts a force upon the material coupled thereto from the roll end, causing rotation and unwinding of the roll end, thereby winding the material from the roll end onto the collector roll.

The apparatus is further comprised of support rollers mounted to said frame parallel to and lower than said pocket rollers. The support rollers provide directional guidance and material tension and pivot points for guiding the material from the roll end to the collector roll, and aid in maintaining a uniform tension upon the material along its propagation path.

The apparatus is further comprised of a means for winding the material from the roll end onto the collector roll, wherein the means for winding feeds said material from said roll end, between said pocket rollers, along said support rollers, and around said collector roll. Thus, rotation of said collector roll pulls the material, causing rotation and unwinding of the roll end, pulling the material from the roll end, down between the pocket rollers, along the support rollers, and winding the material around the collector roll.

The apparatus is further characterized in that the strap resiliently urges against the roll end so as to brake motion thereof. Thus, the means for winding exerts a force upon said material so as to cause the roll end to rotate, and the strap resiliently urges against said roll end so as to partially oppose the rotation of the roll end, thereby resulting in the material being drawn from the roll end to the collector roll at a uniform tension.

In a specific embodiment of the present invention, a newsprint rewinder apparatus, for receiving a roll end and a collector roll having newsprint thereupon, is comprised of free wheeling rollers for supporting said roll end, end plates for positioning said roll end atop said rollers, and means for rotatably supporting a shaft, said shaft for supporting said collector roll. The free wheeling rollers and end plates have, for example, characteristics as described above with reference to the preferred embodiment, and alternate embodiment. The means for rotatably supporting a shaft is, for example, a pair of spaced bushings in parallel relation, or notches, in a side frame, or other suitable means.

The apparatus is further comprised of means for resiliently urging towards the rollers responsive to an operator stimulis. The means for resiliently urging, are, for example, similar to those described for the embodiments above herein.

The apparatus is further comprised of the roll end, the shaft, the collector roll mounted for rotation coincidental with the shaft, and means for rotating the shaft responsive to an enabling stimulis. The roll end is, for example, a partially emptied roll of newsprint. The collector roll is, for example, a roll of newsprint representing an accumulation of salvaged newsprint from a plurality of partially emptied newsprint rolls, accumulated on the collector roll one after another. The collector roll is mounted such that rotation of the shaft causes equivalent and coincidental rotation of the collector roll. For example, the shaft is mounted through the center of the collector roll, such that rotation of the shaft rotates the collector roll therewith. The means for rotating the shaft is, for example, a motor coupled to the shaft, an operator handle coupled to the shaft for manual rotation, or other suitable means for rotating. The enabling stimulis provides an activation signal to initiate rotation of the shaft and collector roll so as to commence rewinding of the newsprint from the roll end to the collector roll. The enabling stimulis is, for example, of the type described with reference to the illustrated embodiments, such as a user operated switch for coupling the power to a motor for rotating the shaft.

The apparatus is further comprised of a frame, wherein said free wheeling rollers, said end plates and said means for rotating are mounted to said frame. Thus, the apparatus forms a single structure, which may be free standing, comprising a pocket web newsprint rewinder apparatus.

The apparatus is further characterized in that said means for rotatably supporting and said means for resiliently urging are mounted to said frame.

The apparatus is further characterized in that said newsprint from said roller end is coupled to said collector roll, such that rotation of said collector roll winds said newsprint from said roll end onto said collector roll. For example, an operator can splice the newsprint from the roll end to the newsprint on the collector roll, via the space between the free wheeling rollers, and can then activate the means for rotating the collector roll so as to cause the newsprint from the roll end to be wound onto the collector roll.

The apparatus is further characterized in that the newsprint from the roll end is passed through the free wheeling rollers and is therefrom coupled to the collector roll. The roll end is positioned and secured by the end plates and is further secured by the means for resiliently urging such that application of a force to pass the newsprint through said free wheeling rollers results in rotation of the roll end upon the free wheeling rollers resulting in feeding the newsprint from the roll end through the space between the free wheeling rollers.

The apparatus is further comprised of support rollers positioned along the coupling path of said newsprint from said roll end to said collector roll, wherein said newsprint passes from said roll end, between said free wheeling rollers, abutting said support rollers, and onto said collector roll. The support rollers provide tension relief points and guidance for the newsprint along the path from the roll end to the collector roll.

The apparatus is further characterized in that said means for resiliently urging abuts said roll end responsive to said operator stimulis so as to act as a payout brake. Thus, for example, tension may be applied to the roll end with air actuated leather belts attached to tension arms comprising the means for resiliently urging, thereby securing said roll end atop said rollers, and providing a tension control for limiting the speed of rotation of the roll end and limiting the rate of payout of the newsprint from the roll end to the collector roll.

The apparatus is further characterized in that said means for resiliently urging is comprised of pneumatically driven leather straps, said straps transversing and abutting said roll end responsive to said operator stimulis. The leather straps, or other suitable material, transverse and abut said roll so as to be positioned perpendicular to the access of rotation of said roll end, so as to limit rotation of the roll end.

The apparatus is further characterized in that said free wheeling rollers, said means for rotatably supporting, and said means for resiliently urging are mounted to said frame in parallel spaced relation, and wherein said end plates are mounted transverse to said free wheeling rollers. Thus, rotation of the roll end and the collector roll and propagation of the newsprint from the roll end to the collector roll occur along a parallel plane of movement. The end plates, being mounted transverse to said free wheeling rollers, are able to provide said support for the roll end, without restricting rotation thereof.

The invention includes other features and advantages which will be described and will become apparent from the following detailed description of a preferred embodiment.

BRIEF DESCRIPTION OF THE DRAWING

The novel features believed characteristic of the present invention are set forth in the appended claims. However, the above advantages and features, as well as others, may be more readily understood by reference to the drawings and accompany detailed description, wherein:

DETAILED DESCRIPTION OF THE DRAWINGS

Figure 1:
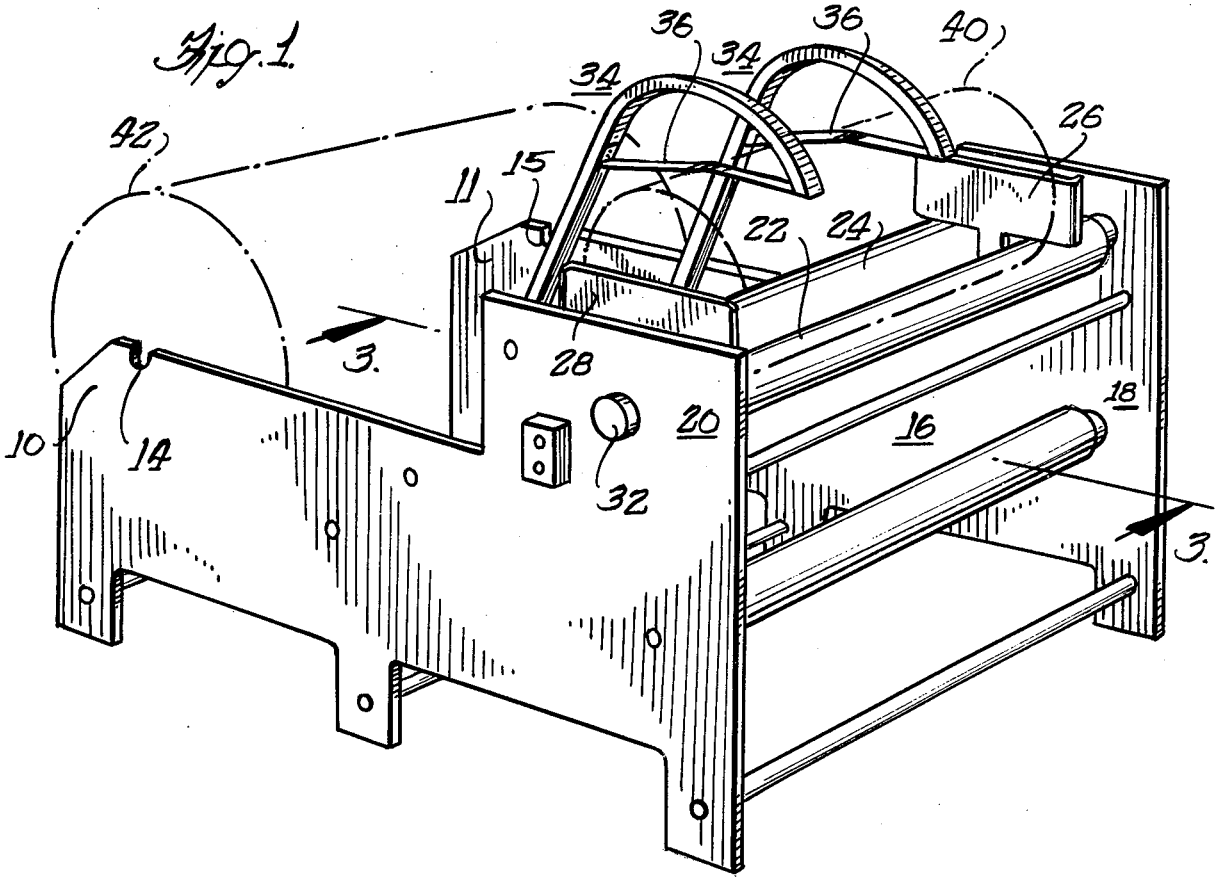
FIG. 1 is a side elevational view of a preferred embodiment of the rewinder apparatus of the present invention.

Referring to FIG. 1, a preferred embodiment of the present invention is shown in side elevational view. A newsprint pocket web rewinder apparatus is comprised of a frame comprising side frames 10 and 11 for providing structural support for members mounted thereupon. A mounting surface, 14 and 15, is positioned atop one side of the frame for receiving a collector roll. A pocket structure 16 is mounted atop said frame at the end opposite the mounting surfaces 14 and 15. The pocket structure 16 is comprised of side walls 18 and 20 mounted atop said frames 10 and 11. Alternatively, the side walls may comprise an extension of the side frames 10 and 11.

Figure 2:
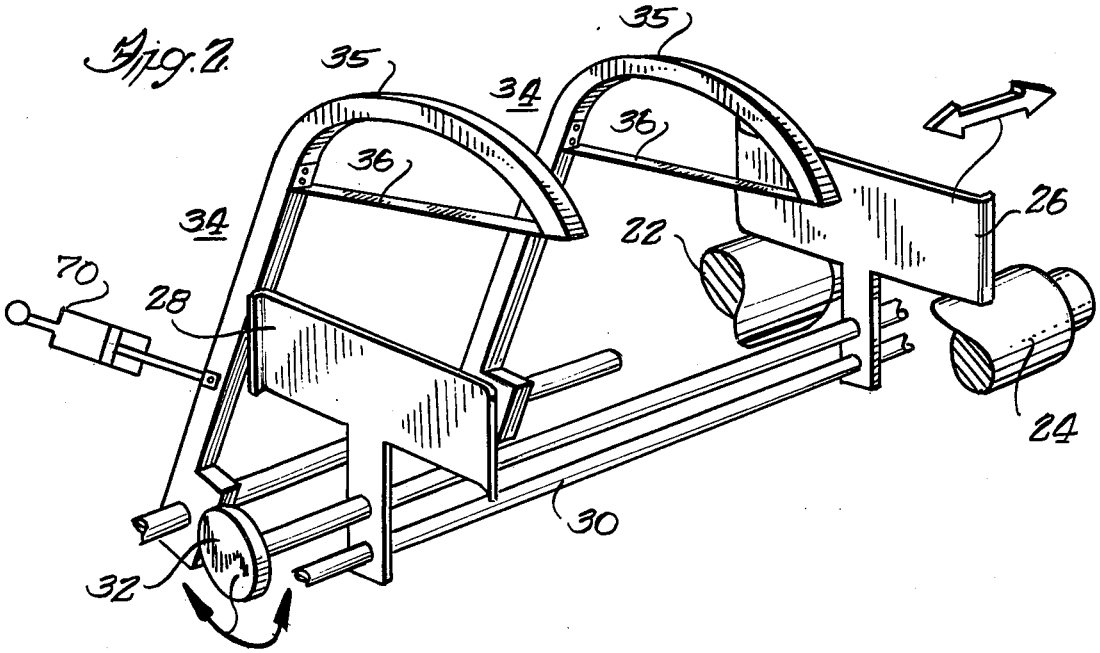
FIG. 2 is a side elevational view of the pocket rollers, sidelay adjustment, end plates, and tension arms, of FIG. 1, shown in enlarged form.

Pocket rollers 22 and 24 are mounted to said side walls 18 and 20, overlying the space between the side frames 10 and 11. End plates 26 and 28 are slideably mounted to a rod 30, not shown in FIG. 1 (as shown in FIG2), said rod 30 lying between and in parallel spaced relation with said pocket rollers 24 and 22. The end plates 26 and 28 are positioned along said rod 30 responsive to rotational movement of a sidelay adjustment 32, which adjusts the location of the end plates laterally between the side frames 10 and 11.

Referring to FIG. 2, the interrelationship of the side walls 18 and 20, pocket rollers 22 and 24, end plates 26 and 28, rod 30, and sidelay adjustment 32, are shown in greater detail than in FIG. 1, and the additional elements of tension arms 34 are shown. The rod 30 is seen to lie beneath the space between the pocket rollers 22 and 24 in parallel spaced relation with rollers 22 and 24. The end plates 26 and 28 are mounted for lateral movements along the rod 30 responsive to manipulation of the sidelay adjustment control 32. A means for resiliently urging, 34, towards said pocket rollers 22 and 24 is shown comprised of tension arms having leather belts attached thereto. Tension is applied with air actuated leather belts attached to the tension arms as will be discussed with reference to FIG. 3.

Figure 3:
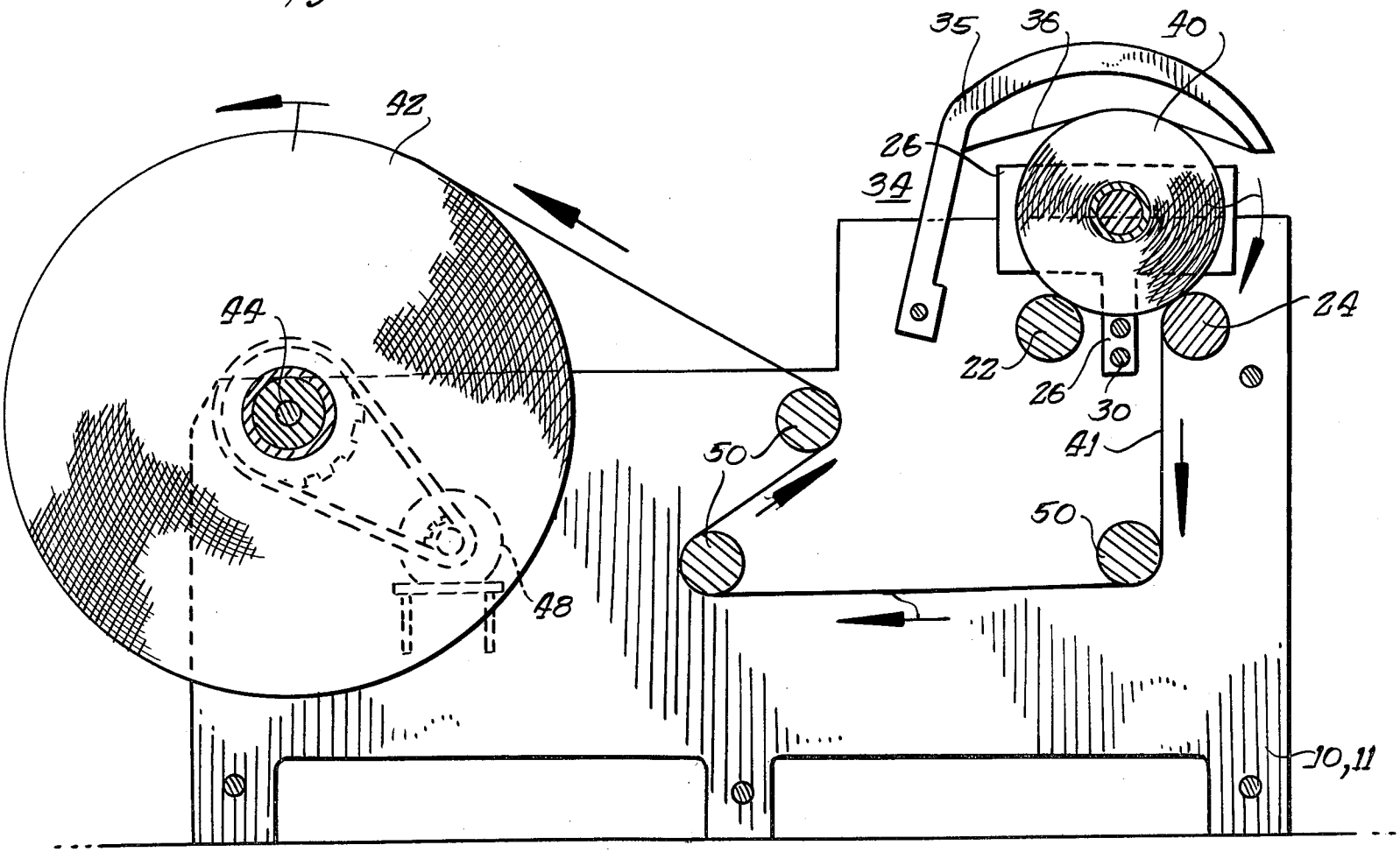
FIG. 3 is a side sectional view of the rewinder of FIG. 1 taken on line 3—3, showing an operative system including roll end, collector roll, means for resiliently urging (tension mens), free wheeling rollers, support rollers, and side frame.

Referring to FIG. 3, a roll end 40 having newsprint thereon is mounted atop said free wheeling pocket rollers 22 and 24, and is secured laterally in position by end plates 26 and 28. The means for resiliently urging against the roll end, tension means 34, is comprised of tension arms 35 and leather straps 36, said leather straps 36 resiliently urging against said roll end 40. A pneumatic drive means 70, as shown in FIG. 2, positions said resilient urging means 34 so as to abut said roll end 40 responsive to a stimulus. The newsprint 41 from the roll end 40 is fed between said free wheeling pocket rollers 22 and 24, around, under and abutting support rollers 50, said newsprint 41 coupling to newsprint on a collector roll 42, such that rotation of the collector roll 42 winds the newsprint 41 thereon. A shaft 44 is mounted through the center of the collector roll 42. The shaft 44 is mounted atop the mounting surfaces 14 and 15 of the side frames 10 and 11, and rotates freely thereupon. The shaft 44 is rotatably driven by a means for rotating the shaft 48, not directly shown. in FIG. 3, which is, in a preferred embodiment, a motor driven means. Upon actuation of the means for rotating, the shaft 44, and collector roll 42, rotate in a counterclockwise direction, winding the newsprint 41 thereupon in a counterclockwise direction, thereby pulling the newsprint 41 along the path from the roll end 40 between the pocket rollers 22 and 24, along, under and abutting the support rollers 50, so as to unwind the roll end 40 and rewind the newsprint therefrom onto the collector roll 42. The force applied on the newsprint 41 is translated to rotational motion of the roll end 40 in conjunction with the support rollers 50 and means for resiliently urging 34. The means for resiliently urging 34, and more specifically the leather straps 36 thereon, resiliently urge against the roll end 40, thereby acting as a payout brake to partially resist the rotation of the roll end 40, thereby resulting in a uniform tension being placed on the newsprint 41 as it traverses the path from the roll end 40 to the collector roll 42.

Although the invention has been described with reference to a specific embodiment, this description is not meant to be construed in a limiting sense. Various modifications of the disclosed embodiment, as well as other embodiments of the invention, will become apparent to persons skilled in the art upon reference to the description of the invention. It is therefore comtemplated that the appended claims will cover any such modifications or embodiments as fall within the true scope of the invention.

What is claimed is:

1. A rewinder apparatus for receiving a roll end having material thereon comprising:
free-wheeling means for supporting said roll end for feeding said material therefrom;
end means for positioning said roll end on said free-wheeling means for supporting the roll end;
said roll end having material thereon;
collector means for receiving and accumulating said material; and,
means for selectively pushing against said roll end responsive to a control stimulus including means for selectively braking said roll end wherein said means for selectively resiliently braking includes tension arms having pneumatically positioned straps.

2. The apparatus as in claim 1 further comprising:
means for rotating said collector means so as to wind said material thereon.

3. The apparatus as in claim 2 wherein said means for rotating is motor driven.

4. The apparatus as in claim 2 wherein:
said roll end rotates in a first direction, and said collector means rotates in a second direction.

5. The apparatus as in claim 3 wherein said first direction is opposite said second direction.

6. The apparatus as in claim 1 or 2 wherein said roll end is a partially emptied roll of newsprint, and wherein said collector means is a collector roll for accumulating said newsprint.

7. The apparatus as in claim 1 or 3 wherein said means for supporting is comprised of a first and a second pocket roller in spaced parallel relation to one another.

8. The apparatus as in claim 7 wherein said means for positioning is comprised of slideable end plates lying partially within said space between said rollers, said end plates movable along an axis parallel to said rollers for contacting said roll end.

9. The apparatus as in claim 1 further comprising a side frame, and a rod mounted to said side frame, wherein said slideable end plates are mounted for movement along said rod,
said rod and said pocket rollers are mounted to said side frame in parallel spaced relation to one another, said rod being positioned in between and below said pocket rollers, and
said collector means is mounted to said side frame in spaced parallel relation to said pocket rollers.

10. The apparatus as in claim 1 further comprising:
means for selectively positioning said slideable end plates responsive to a user stimulus.

11. A rewinding apparatus comprising:
a frame having a mounting surface atop one end;
spaced pocket rollers rotatably mounted in a free-wheeling manner to said frame parallel to said mounting surface;
end plates positioned adjacent said rollers and lying in a plane transverse to the axis of said rollers, said plates mounted for movement along a path parallel to said roller axis;
a roll end having material thereon, said roll end mounted atop, between and abutting said rollers;

collector means for receiving and accumulating said material; and tension means pivotably mounted to said frame in spaced parallel relation to said rollers, said tension means ascending towards said rollers and selectively pushable by a pneumatic movement means against said roll end responsive to a controlled stimulus.

12. The apparatus as in claim 11 further characterized in that said tension means and said frame form an acute angle in the direction of said rollers.

13. The apparatus as in claim 11 further characterized in that said tension means are pivotably mounted to said frame and are selectively resiliently urgable against said roll end responsive to a control stimulus.

14. The apparatus in claim 13 further characterized in that said tension means brake motion of said roll end when resiliently urged thereagainst.

15. The apparatus as in claim 13 wherein said collector means is a collector roll for receiving said material to be wound thereupon, said roll being mounted atop said mounting surface.

16. The apparatus as in claim 15 wherein said material is newsprint.

17. The apparatus as in claim 11 wherein said mounting surface is comprised of bushings recessed atop said frame.

18. The apparatus as in claim 15 further comprising:

means for rotating said collector roll so as to wind said material from said roll end onto said collector roll.

19. The apparatus as in claim 18 wherein said means for rotating is comprised of a motor driven rod abutting and driving said collector roll, said rod being coupled to said mounting surface.

20. The apparatus as in claim 18 further comprising:

support rollers mounted to said frame parallel to and lower than said pocket rollers.

21. The apparatus as in claim 20 further characterized in that said means for rotating feeds said material from said roll end, between said pocket rollers, along said support rollers, and around said collector roll.

22. The apparatus as in claim 11 further characterized in that said tension means selectively abuts said roll end responsive to a control stimulus.

23. The apparatus as in claim 22 further characterized in that said tension means resiliently urges against said roll end so as to brake motion thereof responsive to said control stimulus.

24. The apparatus as in claim 23 wherein said tension means is comprised of tension arms pivotably mounted to said frame, and straps mounted to said tension arms, said straps resiliently urging against said roll end responsive to pivoting of said tension arms responsive to said control stimulus.

25. A newsprint rewinder apparatus, for receiving a roll end and a collector roll having newsprint thereupon, comprising:

free-wheeling rollers for supporting said roll end;

end plates for positioning said roll end atop said rollers;

means for pushing said roll end towards said rollers responsive to an operator stimulus and means for rotatably supporting a shaft, said shaft for supporting said collector roll.

26. The apparatus as in claim 25 further comprising:

said roll end;

said shaft;

said collector roll mounted for rotation coincidental with said shaft; and means for rotating said shaft responsive to an enabling stimulus.

27. The apparatus as in claim 26 further comprising means for pushing said roll end towards said rollers responsive to an operator stimulus.

28. The apparatus as in claim 25 further comprising a frame, wherein said free-wheeling rollers, said end plates, and said means for rotatably supporting are mounted to said frame.

29. The apparatus as in claim 25 or 27 further comprising a frame, wherein said free-wheeling rollers, said end plates, said means for rotatably supporting, and said means for pushing said roll end are mounted to said frame.

30. The apparatus as in claim 27 wherein said newsprint from said roll end is coupled to said collector roll, such that rotation of said collector roll winds said newsprint from said roll end onto said collector roll.

31. The apparatus as in claim 30 wherein said newsprint from said roll end is passed between said free-wheeling rollers and is therefrom coupled to and wound upon said collector roll.

32. The apparatus as in claim 31 further comprising:

support rollers positioned along the coupling path of said newsprint from said roll end to said collector roll, wherein said newsprint passes from said roll end, between said free-wheeling rollers, abutting said support rollers, and winds onto said collector roll.

33. The apparatus as in claim 30 or 31 or 32 wherein said means for pushing said roll end abuts said roll end responsive to said operator stimulus so as to act as a pay-out brake.

34. The apparatus as in claim 25 or 27 wherein said means for pushing said roll end is comprised of pneumatically driven tension arms having leather straps, said straps transversing and abutting said roll end responsive to said operator stimulus.

35. The apparatus as in claim 29 wherein said free-wheeling rollers, said means for rotatably supporting, and said means for pushing said roll end are mounted to said frame in parallel spaced relation, and wherein said end plates are mounted transverse to said free-wheeling rollers.

* * * * *